US005169723A

United States Patent [19]

Forster

[11] Patent Number: 5,169,723

[45] Date of Patent: Dec. 8, 1992

[54] ADHESION OF AUTOMOBILE BODY PUTTY TO GALVANIZED STEEL

[75] Inventor: Wolfgang C. Forster, Jacksonville, Fla.

[73] Assignee: Reichhold Chemicals, Inc., Durham, N.C.

[21] Appl. No.: 510,010

[22] Filed: Apr. 17, 1990

[51] Int. Cl.[5] ..... B32B 15/08

[52] U.S. Cl. ..... 428/458; 427/142; 427/307; 427/327; 427/384; 427/388.1; 428/469; 428/472.2; 428/472.3

[58] Field of Search ..... 428/458, 469, 472, 472.2, 428/472.3, 463; 427/307, 327, 384, 388.1, 142

[56] References Cited

U.S. PATENT DOCUMENTS

| | | | |
|---|---|---|---|
| 1,320,734 | 11/1919 | Chadwick | 428/472.2 |
| 4,233,088 | 11/1980 | Kronstein | 428/472.3 |
| 4,517,255 | 5/1985 | Kanda et al. | 428/472 |
| 4,525,427 | 7/1985 | Bayha et al. | 427/388.1 |

*Primary Examiner*—Paul J. Thibodeau
*Assistant Examiner*—Hoa T. Le
*Attorney, Agent, or Firm*—Rodman & Rodman

[57] ABSTRACT

Chemically etching the surface of galvanized steel with a metal salt that is more electropositive than zinc provides improved adhesion for an unsaturated polyester resin based putty. The invention is particularly suitable for automobile body repair, and the putty can then be shaped to conform to the desired contour of the automobile body.

18 Claims, 1 Drawing Sheet

ADHESION OF AUTOMOBILE BODY PUTTY TO GALVANIZED STEEL

BACKGROUND OF THE INVENTION

1. Field of the Invention

This invention relates to a method for improving the adhesion of automobile body putty to galvanized steel in the repair of automobile body parts.

2. Description of the Prior Art

Automobile and truck bodies have generally been made from mild steel sheet metal. Steel comprises any alloy that contains the element iron as the major component and small amounts of carbon as the major alloying element. These alloys are more properly referred to as carbon steels, and make up well over 90% of the tonnage of steels produced throughout the world.

Low-carbon steels, also referred to as mild steels, usually contain less than 0.25% carbon. These steels are easily hot-worked and are produced in large tonnages for beams and other structural applications. The medium-carbon steels contain between 0.25 and 0.70% carbon, and are most frequently used for machine components that require high strength and good fatigue resistance. High-carbon steels contain more than 0.7% carbon and are in a special category because of their high hardness and low toughness.

It has been well known to repair the dented or gouged steel surfaces of automobile body parts by applying a putty composed of a thermoset resin, such as an unsaturated polyester resin or an epoxy vinyl ester, fillers, promoters, catalysts and other additives, to the damaged metal surfaces. The putty is allowed to harden and is subsequently shaped to conform to the desired contour of the automobile body part.

Standard body putty has successfully been used to repair damaged steel surfaces of automobile bodies. However, rust and corrosion have increasingly become major problems for automobiles whose bodies are manufactured from mild steel.

In order to minimize corrosion, the automobile industry is now considering the replacement of mild steel with zinc-coated or galvanized steel. It has been found that standard body putties that are suitably used with mild steel sheet have poor adhesion to galvanized steel. Thus, an urgent need exists for a means of improving the adhesion of automobile body putty to galvanized steel.

U.S. Pat. No. 4,525,427 to Bayha et al relates to polyester compositions capable of forming a thin film that adheres to metal and plastic substrates, such as steel, and are particularly useful in repairing automobile bodies. These compositions are referred to as "body putty primers." Bayha also discloses that the metallic surface may also be chemically etched to maximize adhesion of surfacing materials to the metal surface.

U.S. Pat. No. 4,531,275 to Kelly discloses a method for repairing automobile bodies made of sheet metal that have been damaged by rust or through an accident. The method involves removing the damaged area and replacing it with a metal patch secured behind the opening with fasteners. The depression behind the opening is then filled with body filler. The metal patch that is used can be galvanized steel.

U.S. Pat. No. 4,732,633 to Pokorny discloses a method for repairing the surface of a damaged metallic body of sheet metal by applying a corrosion resistant patch to the damaged surface so that the back side of the patch is in contact with and adheres to the portion of the bare metal adjoining the damaged surface.

U.S. Pat. No. 4,148,122 to Phillips relates to the repair of automobile bodies made of sheet metal which have been damaged by rust and involves providing a cavity behind the hole or rust area and filling the cavity with a moldable plastic material, then applying a polyester resin filler to the area and grinding the surface of the filler to conform to the surface of the automobile body.

U.S Pat. No. 2,150,929 to Kohler discloses a method for protecting a galvanized metal sheet that has been bent to such an extent that cracking or flaking of the galvanized coating occurs. A mercury amalgam is used to form a protective coating at the bend.

U.S. Pat. No. 4,308,118 to Dudgeon discloses mineral filled epoxy resin compositions that are curable on exposure to heat and ultra violet radiation.

U.S. Pat. No. 2,886,420 to Troy et al discloses a process and apparatus for maintaining the activity of a ferric chloride etching bath used to etch metals such as copper, tin, aluminum and zinc.

U.S. Pat. No. 3,726,707 to Prosser et al relates to the treatment of steel prior to the deposition of a porcelain enamel ground coat or cover coat.

U.S. Pat. No. 3,824,136 to Gilbert discloses a process for chemical milling of fluidic aluminum wafers The process involves spraying thin aluminum sheets with an etching solution consisting of ferric chloride, hydrochloric acid and water.

U.S. Pat. No. 4,482,426 to Maynard et al discloses a method for etching shaped apertures into a strip of nickel-iron alloy with a ferric chloride etchant.

U.S. Pat. No. 4,567,067 to Keal discloses a process for treating the surface of aluminum killed steel for subsequent porcelain coating, with particular application to porcelain coated appliances. The process employs an aqueous ferric sulfate etching solution.

U.S. Pat. No. 3,957,669 to Tulsi et al discloses a method for chemically etching steel prior to metal plating which can be followed by enameling.

SUMMARY OF THE INVENTION

The present invention is based upon the discovery that a chemically etched surface of galvanized steel provides improved adhesion for a polyester resin based automobile body putty. The etching solution comprises a metal salt that is more electropositive than zinc. The putty is applied to the etched surface and after drying is shaped to conform to the desired contour of the automobile body.

BRIEF DESCRIPTION OF THE DRAWINGS

In the accompanying drawings,

FIG. 1 (*b*) is a side view of the metal panel after a 90° bend.

DESCRIPTION OF THE PREFERRED EMBODIMENTS

Figure 1A:
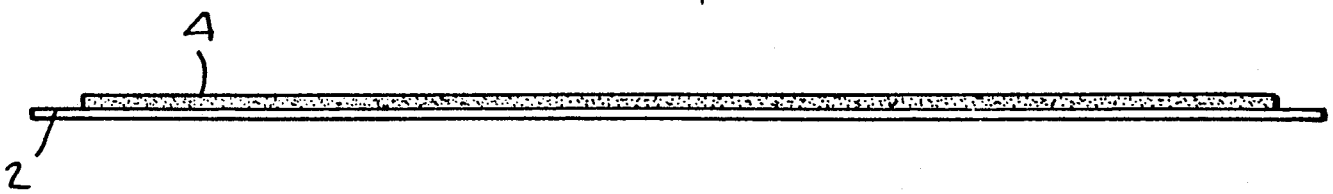
FIG. 1 (*a*) is a side view of a metal panel coated with body putty.

In accordance with the present invention, it has been found that improved adhesion of a polyester resin based putty to galvanized steel can be obtained by etching the surface of the galvanized steel with a solution of a salt more electropositive than zinc and then applying the putty to the etched surface of the galvanized steel. The cured putty forms a superposed layer or laminate with the steel.

The metals that are more electropositive than zinc include iron, cadmium, nickel, lead, tin, copper, silver, mercury, platinum and gold. The salts can be derived from mineral or organic acids, as long as they are soluble. Of these metal salts, from which the etching solution is prepared, iron salts, such as ferrous sulfate, ferrous chloride and ferric chloride, are suitable, with ferric chloride being preferred because of its high solubility.

Most prior art etching compositions intended for the removal of rust are acidic, such as phosphoric acid, acetic acid, and the like. Acid etching is a slow process that is not easily accomplished, and does not lend itself to the immediate results that are necessary in an automobile body repair shop.

In contrast, the inventive neutral salt etching composition provides an immediate reaction and lends itself readily to an automobile body shop repair operation. Moreover, compared with acid-etching, etching with a neutral metal salt is more acceptable from an environmental and safety standpoint, and produces a stronger bond.

When a solution of ferric chloride is applied to a sheet of galvanized iron, a dense grayish coating of iron forms within less than a minute in accordance with the following reaction:

$$3\ Zn + 2\ FeCl_3 \rightarrow 3\ ZnCl_2 + 2\ Fe$$

As shown by the chemical equation, elemental iron replaces the elemental zinc coating the galvanized steel. Care is taken to ensure that a residual layer of zinc remains, by controlling the concentration of etching solution, and duration of the etching. Depending upon the thickness of the galvanized layer, these parameters can be varied. The upper limit of etching solution concentration would be a saturated solution of the salt being used as the etchant. It is comparatively easy to visually distinguish between iron and zinc, since they look different.

The iron is in the form of a dense and coherent film and provides excellent adhesion to both the zinc layer and to the putty that is applied.

When unsaturated polyester resin based automobile body putty was applied to the etched surface, excellent adhesion was obtained.

While chemical etching of regular steel can exhibit some improvement in adhesion to putty, the pronounced improvement in the adhesion of the automobile body putty to galvanized steel is the difference between success and failure.

The extent of the etching can be controlled by the concentration and amount of the ferric chloride solution applied. The etch should be controlled so as not to remove the entire layer of zinc coating the galvanized steel, since this might eliminate some corrosion protection.

It has also been found that the etching process can be further accelerated by adding a minor amount of acid, such as phosphoric acid to the solution of the metal salt, on the order of about 1 to 10 grams of a phosphoric acid, such as ortho-phosphoric acid, per 100 grams of water used in an etching solution containing a saturated amount of ferric chloride.

Even if the entire zinc coating was removed from the galvanized steel during the etching process, improved adhesion can still be obtained because the steel beneath the zinc coating becomes etched by the ferric chloride solution according to the following equation:

$$Fe + 2FeCl_3 \rightarrow 3\ FeCl_2$$

The $FeCl_2$ coating is soluble, and can be washed off with water leaving the etched steel surface to which the putty can be bonded.

After the surface has been washed with water and dried, an unsaturated polyester resin based automobile body putty is applied. No primer or other pretreatment is necessary. The preferred automobile body putty comprises a thermosetting resin, preferably a blend of unsaturated polyester resin promoter, and a filler that is primarily talc. Vinyl ester resins can also be used. Typical suitable automobile putty formulations based on unsaturated polyester resins are described in U.S. Pat. No. 4,525,427 to Bayha, the disclosure of which is incorporated by reference herein.

The following examples illustrate specific embodiments of the subject invention. All parts and percentages are by weight, unless otherwise indicated.

EXAMPLE 1

A. Preparation of Resin 0.25 mols maleic anhydride, 0.75 mols phthalic anhydride and 1.05 mols diethylene glycol were esterified at 215° C. until the acid number dropped below 28.

The resin was cooled, 80 parts per million (ppm) of hydroquinone, 25 ppm of para benzoquinone were added and enough styrene to produce a liquid resin containing 30% styrene. This liquid was labeled "Resin A".

B. Preparation of Automobile Body Putty

A body putty was prepared from the following components:

| Component | Parts By Weight |
|---|---|
| Resin A | 39.712 |
| 1,4-naphthoquinone | 0.004 |
| Cobalt-2-ethyl hexoate (corresponding to 12% cobalt as metal) | 0.024 |
| N,N-dimethyl aniline | 0.026 |
| Powdered talc | 60.00 |

100 grams body putty plus 2 grams 50% paste of benzoyl peroxide catalyst also referred to as dibenzoyl peroxide produced a gel time of about 4 to 6 minutes.

C. Preparation of Etching Solution

An etching solution was prepared by dissolving 80 rams anhydrous ferric chloride in 100 grams of distilled water.

D. Galvanized Steel

Nominal "20 gauge" galvanized steel, actual thickness 0.038 inches, was cut into 3 inch by 8 inch panels.

E. Regular Steel

Nominal "20 gauge" regular steel, actual thickness 0.032 inches, was cut into 3 inch by 8 inch panels.

EXAMPLE 2

Surface Treatment

Regular Steel, Sanded: The regular steel panels were sanded with #80 grit abrasive paper, followed by wiping with a paper towel soaked in acetone.

Regular Steel, Etched: The regular steel panels were sanded with #80 grit abrasive paper and acetone-wiped as described above. The etching solution of Example 1 was applied to the steel panels with a paint brush, allowed to remain thereon for 45 seconds and was then rinsed with distilled water. The panel was dried with a paper towel.

Galvanized Steel, Sanded: The galvanized steel panels were sanded with #80 grit abrasive paper and acetone-wiped.

Galvanized Steel, Etched: The galvanized steel panels were sanded with #80 grit abrasive paper and acetone-wiped. The etching solution of Example 1 was applied with a paint brush for 45 seconds and then rinsed off with distilled water. The panels were dried with a paper towel. They exhibited a dense grayish layer which was ascertained to be iron. It was further ascertained that beneath the iron layer, a layer of zinc still remained on the panel.

EXAMPLE 3

Adhesion of Body Putty to Metal Surfaces

A. After Dry Heat Aging

Figure 1B:
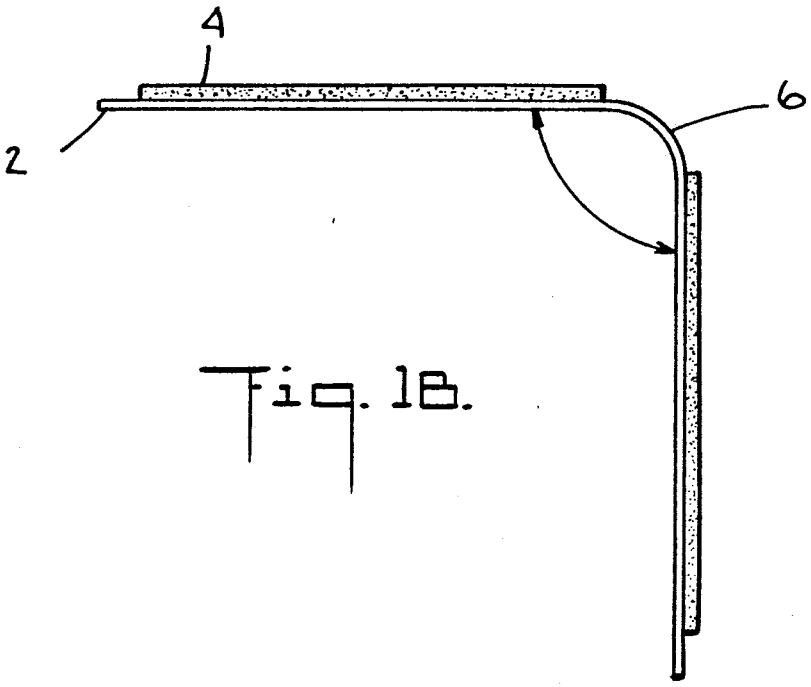

The sheet metal panels, 3 inches by 8 inches from Example 2 were treated as follows: 100 grams body putty from Example 1 B was mixed with 2 grams of a 50% benzoyl peroxide paste catalyst and a 2 inch by 5 inch by 0.01 inch layer of the catalyzed putty was applied with a doctor blade to the metal surface. In FIGS. 1(*a*) & 1(*b*) are shown a side view of the laminated metal panel 2 coated with body putty 4. The putty started to harden after about 4–5 minutes at ambient conditions. The specimens were allowed to cure for 24 hours at room temperature. They were then postcured for 3 hours at 105° C. After aging for 24 hours beyond the post cure period at room temperature, the specimens were subjected to 90° bending. In FIG. 1(*b*), the area 6 where loss of adhesion occurred after the 90° bend, is referred to as the "gap".

Upon bending, the adhesion of the putty was evaluated by measuring the length of the gap at the 90° bend where the dried putty separated from the panel. The extent of adhesion of the layer of body putty remaining bonded to the metal substrate was also evaluated.

B. After Humid Heat Aging

Specimen preparation as in "3A", except that the putty was applied as a layer 0.038 inches thick. The putty was allowed to cure at room temperature for 24 hours, after which the specimens were immersed in 95° C. distilled water for 2 hours. The specimens were then removed, dried and kept at room temperature for 24 hours and subjected to the bending test.

Adhesion was rated as follows:

Excellent: Gap no longer than 0.5 inches. Residual body putty adhering to the substrate at the gap. The remaining layer of body putty beyond the gap bonded firmly to the panel.

Good: Same as above, except that gap is 1.0 to 1.5 inches.

Satisfactory: Same as above, except that gap is 1.5 to 2.5 inches.

Failed: Complete or almost complete separation of entire layer of body putty.

Results of the evaluation are tabulated in Table 1 as follows:

TABLE 1

| Substrate | Adhesion After Dry Heat Aging | Adhesion After Humid Heat Aging |
|---|---|---|
| Galvanized Steel Sanded | Failed | Failed |
| Galvanized Steel Etched | Excellent | Excellent |
| Regular Steel Sanded | Satisfactory | Satisfactory |
| Regular Steel Etched | Good | Good |

Although this invention has been described in the context of automobile body repair applications, it is readily apparent that in its broadest aspects, this invention can be utilized to repair all types of damages steel surfaces which has been manufactures from sheet steel.

What is claimed is:

1. A method for repairing a damaged zinc coated steel substrate comprising:

(a) etching the substrate surface by contacting it with an etching solution comprising an aqueous metal salt etchant that is more electropositive than zinc, to thereby etch a coating of the elemental metallic moiety of the etchant on the substrate surface;

(b) coating a resin based putty on the etched substrate surface, wherein the resin is selected from the group consisting of vinyl ester resin and unsaturated polyester resin; and (c) curing and shaping the putty to complete the repair.

2. The method of claim 1, wherein the zinc coated substrate comprises an automobile body.

3. The method of claim 1, wherein the metallic moiety of the metal salt is a metal selected from the group consisting of iron, cadmium, nickel, lead, tin, copper, silver, mercury, platinum, gold, and mixtures thereof.

4. The method of claim 3, wherein the metal is selected from the group consisting of ferrous iron and ferric iron.

5. The method of claim 1, wherein the metal salt etchant comprises ferric chloride.

6. The method of claim 5, wherein the etching solution also includes about 1 to 10% of a phosphoric acid, based on the weight of the water in the etching solution.

7. The method of claim 1, wherein the resin is selected from the group consisting of an unsaturated polyester resin, a vinyl ester resin, and mixtures thereof.

8. The method of claim 7, wherein the resin is an unsaturated polyester resin.

9. The method of claim 7, wherein the resin is a vinyl ester resin.

10. The method of claim 1, wherein the putty is an automobile body putty comprising a blend of unsaturated polyester resins, promoter and filler.

11. A laminate comprising a zinc coated steel substrate with an etched surface of an elemental metal moiety deposited thereon from an etching solution comprising an aqueous metal salt etchant that is more electropositive than zinc, and having a layer of resin based putty coated on the etched surface.

12. The laminate of claim 11, wherein the zinc coated substrate comprises an automobile body.

13. The laminate of claim 11, wherein the metallic moiety of the metal salt is a metal selected from the group consisting of iron, cadmium, nickel, lead, tin, copper, silver, mercury, platinum, gold, and mixtures thereof.

14. The laminate of claim 13, wherein the metal salt is selected from the group consisting of ferrous iron and ferric iron.

15. The laminate of claim 11, wherein the metal salt etchant comprises ferric chloride.

16. The laminate of claim 11, wherein the resin is selected from the group consisting of an unsaturated polyester resin, a vinyl ester resin and mixtures thereof.

17. The laminate of claim 16, wherein the resin is an unsaturated polyester resin.

18. The laminate of claim 16, wherein the resin is a vinyl ester resin.

* * * * *